United States Patent [19]

Kwiatek

[11] Patent Number: 4,854,610

[45] Date of Patent: Aug. 8, 1989

[54] METHOD OF MAKING LAMINATED ARTICLES AND ARTICLES MADE THEREFROM

[75] Inventor: Alfred Kwiatek, Swanton, Vt.

[73] Assignee: Bertek, Inc., Swanton, Vt.

[21] Appl. No.: 154,951

[22] Filed: Feb. 10, 1988

[51] Int. Cl.[4] ..... B41L 1/20; B42D 19/00; B42D 15/00; B44C 1/18

[52] U.S. Cl. ..... 282/11.5 A; 283/81; 156/234

[58] Field of Search ..... 281/11.5 A, 18, 21, 281/23 R; 283/81; 428/40, 41, 313.1, 354; 156/234, 240, 241; 282/11.5 A

[56] References Cited

U.S. PATENT DOCUMENTS

| | | | |
|---|---|---|---|
| 4,060,168 | 1/1977 | Romagnoli | 206/216 |
| 4,110,502 | 8/1978 | Baer | 428/40 |
| 4,211,434 | 7/1980 | Reese | 282/11.5 A |
| 4,379,573 | 4/1983 | Lomeli et al. | 428/42 |
| 4,507,166 | 3/1985 | Posner | 156/235 |
| 4,544,590 | 10/1985 | Egan | 428/40 |
| 4,582,736 | 4/1986 | Duncan | 428/40 |
| 4,626,460 | 12/1986 | Duncan | 428/40 |
| 4,627,994 | 12/1986 | Welsch | 282/11.5 A |
| 4,636,432 | 1/1987 | Shibano et al. | 428/327 |
| 4,664,416 | 5/1987 | Steidinger | 282/11.5 A |
| 4,696,843 | 9/1987 | Schmidt | 282/11.5 A |

*Primary Examiner*—Frank T. Yost
*Assistant Examiner*—Paul M. Heyrana, Sr.
*Attorney, Agent, or Firm*—Lerner, David, Littenberg, Krumholz & Mentlik

[57] ABSTRACT

A method of manufacturing adhesive-backed sheet components having release liners attached to and covering the adhesive backs thereof, and an article made by such method are disclosed. The method comprises the steps of providing an elongate, marginally punched, continuous sheel substrate having a series of consecutive panels that are separable from one another along transverse score lines positioned therebetween; applying a layer of release coating material to a corresponding predetermined minor portion of each of the panels; applying a layer of pressure sensitive adhesive to at least a portion of the layer of the release coating material within the minor portion of each of the panels; applying a sheet component atop the pressure sensitive adhesive within the minor portion of each of the panels to adhere the sheet component to the panel; providing score lines about the periphery of the minor portion of each of the panels so as to allow the sheet component, the pressure sensitive adhesive layer, the release coating layer, and the minor portion of the panel to be removed from the remainder of the panel as an integral laminate unit; and, removing the integral laminate unit from the remainder of each of the panels. The article of this invention comprises the aforesaid sheet substrate having panels thereon each of which is provided with an integral laminate unit thereon that is separable therefrom.

6 Claims, 3 Drawing Sheets

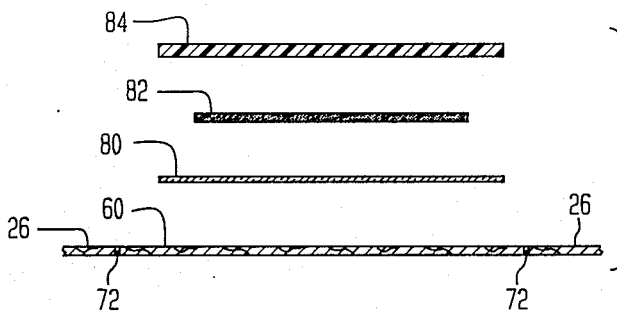
FIG. 3
FIG. 4
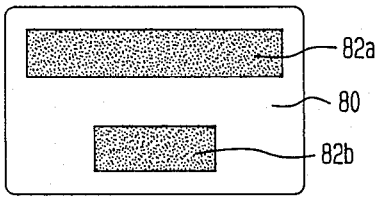
FIG. 5
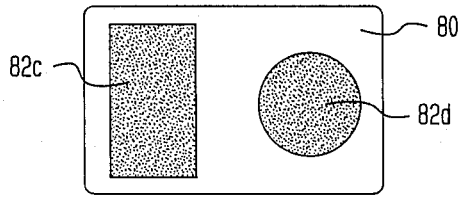

METHOD OF MAKING LAMINATED ARTICLES AND ARTICLES MADE THEREFROM

FIELD OF THE INVENTION

This invention relates to a method of making laminated articles and to articles made by such method. More particularly, the method of this invention relates to the transferring of pressure sensitive adhesive from a release coated, selected minor area on each of a series of separably connected panels of a sheet substrate to the back surface of each of a plurality of correspondingly sized sheet components adhered to the panels within the minor areas thereof.

BACKGROUND OF THE INVENTION

In the manufacture of sheet components, for example cards, tags, labels, coupons and the like, in accordance with one known method such sheet components are commonly affixed to separably connected panels of a sheet substrate, for example marginally punched elongate computer print out paper, the various sheets of which are connected by transversely extending scored lines. The sheet components are affixed to the panels by pressure sensitive adhesive which has either been permanently coated onto the various panels or has been applied thereto by initially having been coated onto the back surfaces of the sheet components and then permanently adhered to the sheet substrate panels when the sheet components are affixed thereto. As a result, sheet components which are affixed to the panels of continuous sheet substrates by this method either have no adhesive on their back surfaces when they are detached from the sheet substrate, or they are permanently affixed to the sheet substrate.

In another known method of manufacturing such sheet components the back surface of the sheet component is coated with pressure sensitive adhesive and the pressure sensitive adhesive is then covered with a protective liner having a layer of release coating material on the upper surface thereof which abuts the pressure sensitive adhesive coating. The undersurface of the protective liner, in turn, is adhesively bonded to the sheet substrate so that when the sheet component is removed from the panel, the back surface of the sheet component remains coated with the pressure sensitive adhesive. Although this method provides sheet components having pressure sensitive adhesive on their back surfaces, the method employed is uneconomical in that it requires the use of an intermediate release-coated protective liner having an extra layer of adhesive on its undersurface in order to make the desired sheet components. Also, the adhesive-coated back surfaces of the sheet components are unprotected by protective liners when they are removed from the sheet substrate since the protective liners permanently adhere to the sheet substrate.

It is, therefore, a primary object of the present invention to provide an improved method for making a sheet component having a pressure sensitive adhesive coating on its back surface.

An additional object of this invention is to provide an improved method for making a sheet component having a pressure sensitive adhesive coating on its back surface which coating is covered by a release-coated protective liner.

Another object of this invention is to provide an improved method for providing a removable, pressure sensitive adhesive-backed sheet component on a continuous moving sheet substrate during a single pass of the sheet substrate through sheet material processing equipment.

A further object of this invention is to provide an improved method for making pressure sensitive adhesive-backed sheet components, in which method pressure sensitive adhesive material is transferred from release coated areas on a sheet substrate to the back surfaces of the sheet components.

Yet another object of this invention is to provide an improved laminated sheet component having a pressure sensitive adhesive layer on its back surface and a release-coated protective liner covering such adhesive layer, the protective liner comprising a minor area of a sheet substrate that is separable from the sheet substrate along score lines formed therein.

Additional objects and advantages of this invention will become apparent as the following description proceeds:

SUMMARY OF THE INVENTION

Briefly stated, and in accordance with one embodiment of this invention, a method of manufacturing adhesive backed sheet components having release liners attached to and covering the adhesive backs thereof comprises the steps of providing an elongate, marginally punched, continuous sheet substrate having a series of consecutive panels that are separable from one another along transverse score lines positioned therebetween; applying a layer of release coating material to a corresponding predetermined minor portion of each of the panels; applying a layer of pressure sensitive adhesive to at least a portion of the layer of the release coating material within the minor portion of each of the panels; applying a sheet component atop the pressure sensitive adhesive within the minor portion of each of the panels to adhere the sheet component to the panel; providing score lines about the periphery of the minor portion of each of the panels so as to allow the sheet component, the pressure sensitive adhesive layer, the release coating layer, and the minor portion of the panel to be removed from the remainder of the panel as an integral laminate unit; and, removing the integral laminate unit from the remainder of each of the panels so that each of the integral laminate units thereafter includes the sheet component, the pressure sensitive adhesive attached thereto and the release-coated minor portion of the panel adhered to and covering the pressure sensitive adhesive. The minor portion of the panel thus functions as a releasable liner on the integral laminate unit, which releasable liner, when removed, exposes the pressure sensitive adhesive attached to the sheet component, facilitating subsequent adhesion of the sheet component to another object.

In accordance with another embodiment of this invention, there is provided an elongate, marginally punched, continuous sheet substrate which comprises a series of consecutive panels that are separable from one another along transverse score lines positioned therebetween. Each of the panels includes a laminated area thereon covering a minor portion of the panel. The laminated area includes a layer of release coating material adhered to the minor portion of the panel, a layer of pressure sensitive adhesive material adhered to at least a portion of the layer of release coating material within the minor portion of the panel, and a sheet component positioned atop the pressure sensitive adhesive layer within the minor portion of the panel and held on to the panel by the pressure sensitive adhesive. Each of the panels is provided with score lines positioned about the periphery of the minor portion of the panel to allow the sheet component, the pressure sensitive adhesive layer, the release coating layer, and the minor portion of the panel to be removed from the remainder of the panel as an integral laminate unit. The integral laminate unit comprises the sheet component, the pressure sensitive adhesive attached thereto, and the release-coated minor portion of the panel adhered to and covering the pressure sensitive adhesive. The minor portion of the panel functions as a releasable liner on the integral laminate unit, which releasable liner, when removed, exposes the pressure sensitive adhesive attached to the sheet component, facilitating subsequent adhesion of the sheet component to another object.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

FIG. 3 is an enlarged, exploded, sectional elevational view through a laminated sheet component and the sheet substrate of FIG. 1, taken along the line 3—3 of FIG. 1; and, FIG. 4 and 5 are plan views of release-coated areas of the sheet substrate showing alternative patterns which may be used when depositing the pressure sensitive adhesive of this invention onto the sheet substrate.

DETAILED DESCRIPTION OF THE INVENTION

Figure 1:
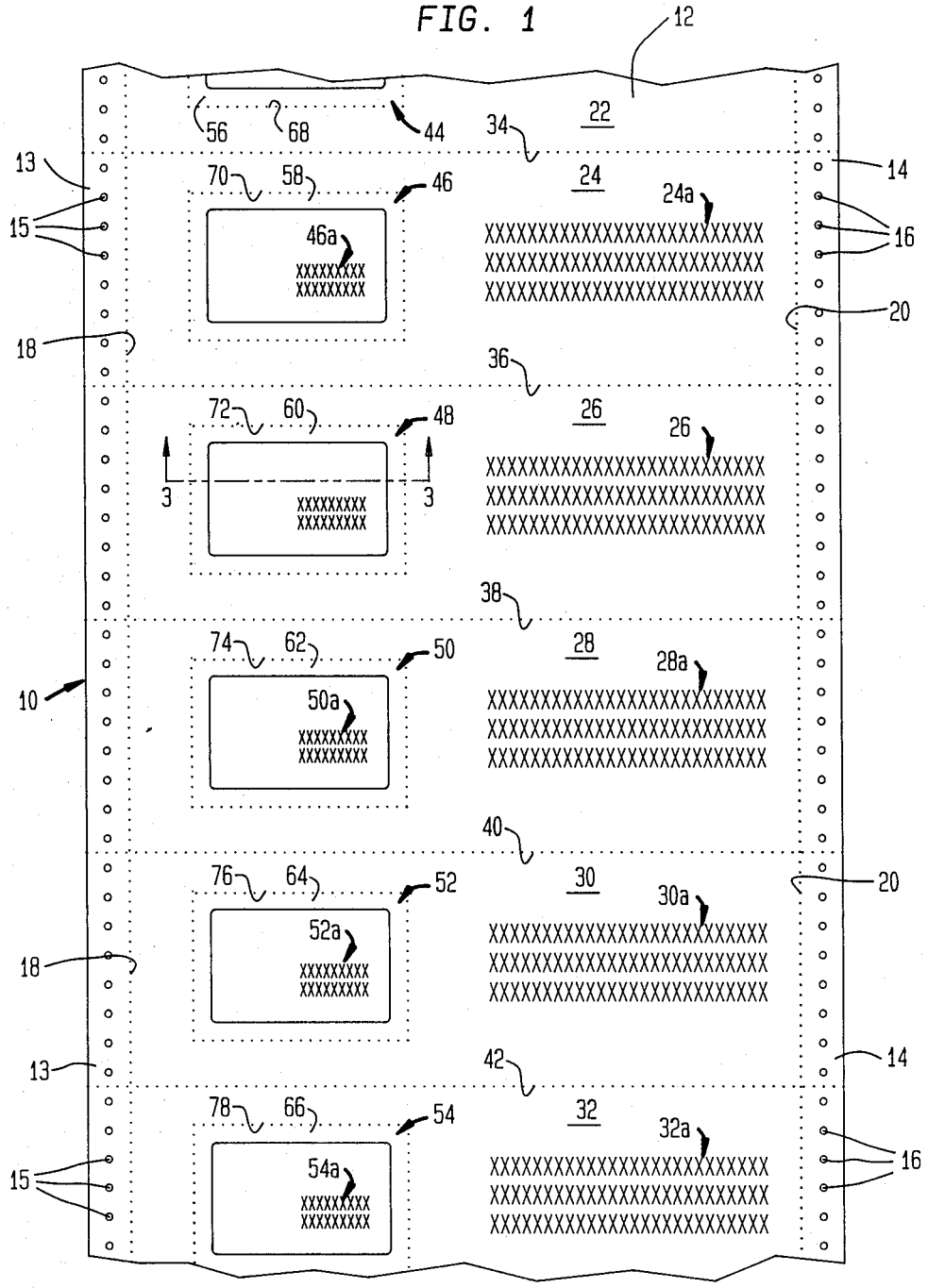
FIG. 1 is a plan view of a plurality of interconnected, separable panels of an elongate, marginally punched, continuous sheet substrate, each of the panels of which are provided with laminated sheet components in accordance with this invention.

Referring to FIG. 1, a sheet substrate in accordance with this invention has been illustrated generally at 10. The sheet substrate 10 may comprise a continuous sheet 12 of single-ply or multi-ply paper which, in the case of multi-ply paper, may have sheets of carbon paper (not shown) interleaved therein or may comprise known chemically treated sheets which transmit imprinted data from one sheet to another without the use of interleaved carbon sheets. The continuous sheet 12 may comprise computer printout paper but it can also be made of tag stock. Sheet 12 is preferably provided with marginal edge portions 13 and 14 having respective marginally punched holes 15 and 16 adjacent its opposite edges. The marginal edge portions 13 and 14 of sheet 12 are separated from the main central portion of the sheet by respective score lines 18 and 20 so that the edge portions can be cleanly torn free from the central portion of the sheet.

The continuous sheet 12 includes a plurality of interconnected panels 22, 24, 26, 28, 30 and 32 which are separable from one another along transversely extending score lines 34, 36, 38, 40 and 42. The panels 22–32, in a preferred embodiment of this invention, comprise business forms on which suitable predetermined data, for example the data shown at **24*a*, 26*a*, 28*a*, 30*a* and 32*a*, is printed. Each of the panels 22, 24, 26, 28, 30, and 32 has adhered thereto respective laminated sheet components, shown generally at 44, 46, 48, 50, 52 and 54, on which suitable predetermined data, for example the data shown at 46*a*, 48*a*, 50*a*, 52*a* and 54*a*, may be provided. The sheet components 44–54 are adhered to the panels 22–32 in manner to be described in greater detail hereinafter. The laminated sheet components 44–54 each cover respective minor portions 56, 58, 60, 62, 64 and 66 of the total areas of their respective panels 22–32 and are circumscribed by respective score lines 68, 70, 72, 74, 76 and 78, which allow the minor portions 56–66 to be torn free from the remaining major portions of the panels or business forms 22–32 so that the laminated sheet components 44–54 can be handled separately from the forms 22–32**.

Figure 2:
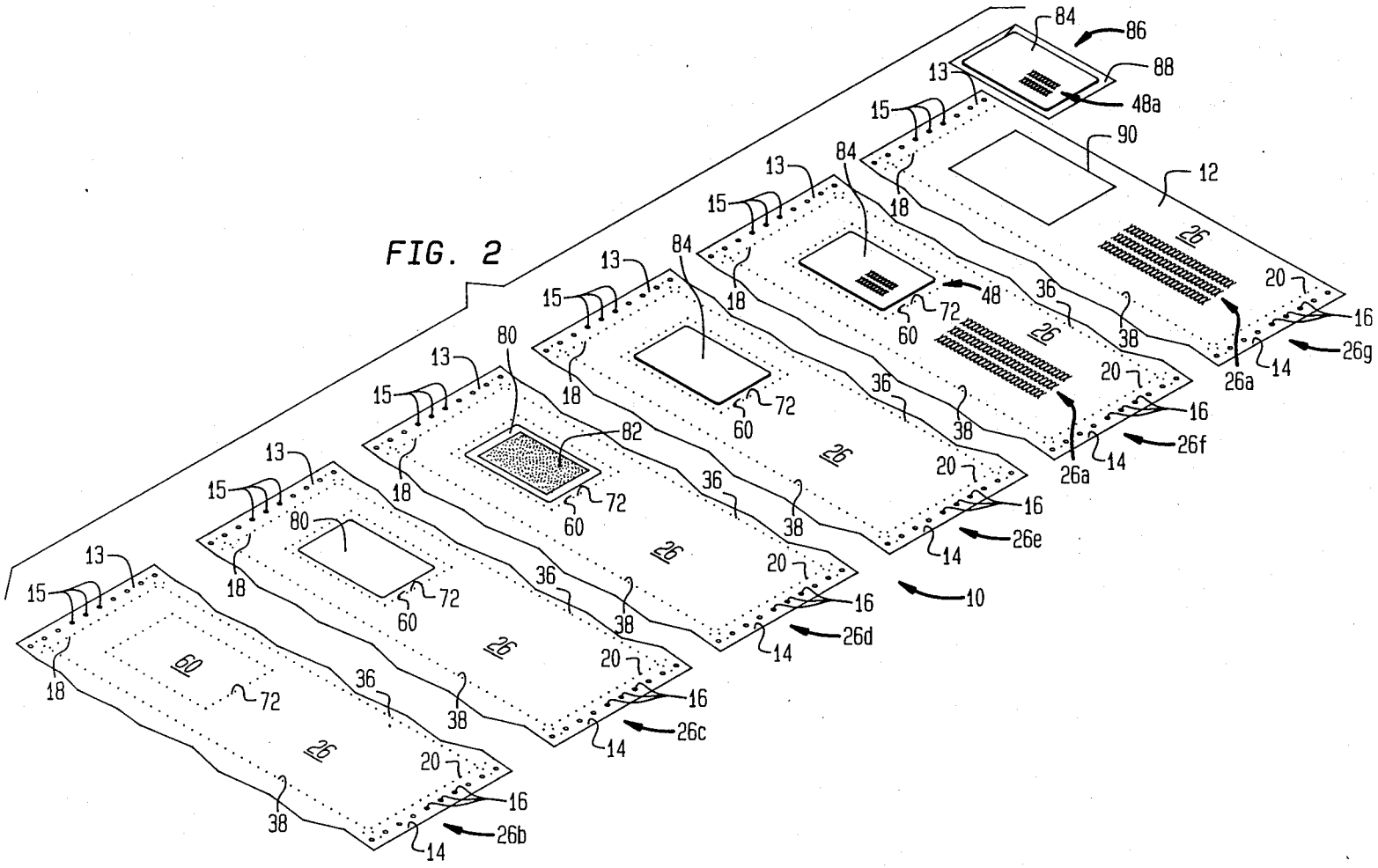
FIG. 2 is a plan view, with parts omitted for clarity, showing the various steps which a panel on the sheet substrate of this invention undergoes in accordance with the method of this invention.

Referring now to FIGS. 2 and 3, the method of manufacturing adhesive backed sheet components having release liners attached to and covering the adhesive backs thereof, will now be described in greater detail. For descriptive purposes, the method steps of the invention will be described in connection with the processing of panel 26 of FIG. 1. The panel 26 is identified in FIG. 2 at **26*b*, 26*c*, 26*d*, 26*e*, 26*f*, and 26*g* during various of the steps of the method. Initially, as shown at 26*b*, the panel 26 is one of a series of interconnected panels that make up the continuous sheet 12 of sheet substrate 10. It includes on it, or may have die cut into it as one of the steps of the method, the score line 72 which surrounds the minor portion 60 of the total area of panel 26**.

As the first step in the process (when the panel 26 has either been received from the paper manufacturer with the score line 72 in it already, or when the score line 72 is added to the panel 26 as a second or subsequent step in the process), the panel 26 is moved to a chemical release coat printing station (not shown) whereat a release coating layer 80, for example silicone, is imprinted on the panel 26, as shown at **26*c*, within the minor area portion defined by, or later to be defined by, the score line 72. The release coating layer 80 is applied in any shape or size and repeats on each consecutive panel 22–32 (FIG. 1). The release coating material is formulated as a typical release for pressure sensitive adhesives. It should be strong enough to hold the laminated sheet components 44–54 in place on the forms 22–32 while the forms and components thereon are transported through various subsequent operations which may be performed thereon, for example imprinting, detaching, bursting, etc., but it should also be weak enough to allow the minor portions 56–66 of the panels 22–32 to release from the laminated sheet components 44–54** without retaining any adhesive residue thereon.

The next step in the process involves the application of a pressure sensitive adhesive layer 82 atop the chemical release coating layer 80. This is done at a suitable adhesive coating station (not shown) to which the panel 26 is brought, as shown at **26*d*. The pressure sensitive adhesive layer 82 may be of varying size and shape. For example, it may have the integral, rectangular form shown at 82 in FIGS. 2 and 3 or, referring to FIGS. 4 and 5, it may be made up of one or more strips or spots, for example the strips 82*a* and 82*b* of FIG. 4 or the strip 82*c* and spot 82*d* of FIG. 5. The pressure sensitive adhesive layer 82 may be applied atop the release coated area 80 by any suitable coating method, for example by silk screening, roller coating, or rotogravure coating, and it is repeated on each consecutive form 22–32 on the sheet substrate 10. The overall area covered by the pressure sensitive adhesive 82 should be equal to or slightly smaller than the area of the release coating layer 80 in order to facilitate eventual removal of the sheet components 44–54 from the minor portions 56–66 of the panels 22–32**.

After the layer of pressure sensitive adhesive 82 is applied to the panel 26, the panel is moved to another station at which suitable processing machinery (not shown) applies an outer sheet component 84 atop the pressure sensitive adhesive layer 82, as shown in FIG. 2 at 26*e*. The outer sheet component 84 may comprise a single cut component of rigid or semi-rigid paper, board, metal, plastic sheeting, plastic film, textile fabric, non-woven fabric, or the like. It should be flat and reasonably thin, for example 3 mils to approximately 40 mils in thickness. It may comprise a card, tag, label, coupon, envelope, decal, sticker, name plate, badge, sign, shelf strip, shelf pointer, or the like. The outer sheet component 84 is affixed to each panel 22–32 of the sheet substrate 10 by the pressure sensitive adhesive 82. Component 84 is located anywhere on the panels 22–34 that is designated as the minor portion 56–66 thereof by the application of release coating layer 80 and pressure sensitive adhesive 82 thereon. Preferably, the outer sheet component 84 is capable of being printed on by a computer or typewriter at the same time as the major portion of the panel 22–32 is being printed on. In this regard component 84 is preferably flexible enough to pass through the platens of a computer printer or typewriter and is made of a material that will accept print on its surface. The imprinting step of the method is shown in FIG. 2, wherein panel 26 is shown at 26*f* having data imprinted both on the panel itself and on the outer surface of the sheet component 84, at 26*a* and 48*a*, respectively. Preferably, the two sets of data 26*a* and 48*a* are correlated so that the data 26*a* provides a record of the data 48*a* when the latter, in turn, is passed along to the ultimate user of the sheet component 84.

If the sheet substrate 10 was not originally received from the paper manufacturer with score lines 68–78 already in place, and if such score lines were not applied to the panels prior to applying one or more of the layers 80, 82 and 84 onto the panels, the score lines 68–78 should now be applied to the panels 22–32 to facilitate removal of the minor portions 68–78 and their attached laminated sheet components 44–54 from the panels 22–32. The score lines 68–78 are preferably peripheral perforations that surround the perimeter of the outer sheet component 84 and are easy to tear by hand. They should be located on the upper ply of the sheet substrate 10 when multi-ply sheet substrates are employed, to allow the outer sheet component 84, the pressure sensitive adhesive layer 82, the release coating layer 80 and the minor portions 56–66 of the panels 22–32 to be detached from the rest of each of the upper ply panels as integral laminate units, one of which is shown at 86 in FIG. 2, when the score lines 68–78 are torn and the laminated sheet components 44–54 are removed from the sheet substrate 10. The minor area portions 56–66 of the panels, which are torn away as part of the laminate sheet components 44–54, act as release-coated protective liners, one of which is shown at 88 in FIG. 2, for the adhesive layers 82. When the release-coated protective liners 88 are eventually removed from the integral laminate units 86, the pressure sensitive adhesive layers 82 on the backs of the outer sheet components 84 are exposed. The opening left in the panel 26 when the minor area portion 60 has been removed therefrom is shown at 90 in FIG. 2.

From the foregoing description, it will be seen that the adhesive layers 82, which were originally laid on top of the release coated layers 80 of the sheet substrate 10, have been transferred to the undersides of the outer sheet components 84 and have become part of the outer sheet components 84. Thus, a non-adhesive sheet component 84 has become adhesive by acquiring the adhesive which was used to affix the sheet component to the sheet substrate. In addition, after the integral laminate units 86 have been removed from the sheet substrate 10, they comprise sheet components 84 having pressure sensitive adhesive coatings 82 on their back surfaces, which coatings are covered by release-coated protective liners 88. Moreover, the outer surfaces of the sheet components are imprinted with data that may be correlated with data that is imprinted on the panels from which they were detached. The data on the panels thus serves as a record of the data on the sheet component.

While there has been shown and described what is presently considered to be the preferred embodiment of this invention, it will be obvious to those skilled in the art that various changes and modifications may be made without departing from the broader aspects of this invention. For example, the release coating layer 80 does not have to be confined within the perimeter of the score line 72. It can extend beyond the score line, covering the entire panel 26 if desired, so long as the score line 72 surrounds the area of the adhesive layer 82 and the latter covers only a minor portion of the area of the panel. Similarly, the area enclosed within score line 72 can either be larger or smaller than the outer sheet component 84, so long as the score line 72 surrounds the area of the adhesive layer 82 and constitutes a minor portion of the area of the panel. It is, therefore, aimed in the appended claims to cover all such changes and modifications as fall within the true spirit and scope of this invention.

What is claimed is:

1. A method of manufacturing adhesive backed sheet components having release liners attached to and covering the adhesive backs thereof, comprising the steps of providing an elongate, marginally punched, continuous sheet substrate having a series of consecutive panels thereon that are separable from one another along transverse score lines positioned therebetween; applying a layer of release coating material to at least a corresponding predetermined portion of each of said panels; applying a layer of pressure sensitive adhesive to at least a portion of said layer of release coating material within a minor portion of each of said panels; applying a sheet component atop said pressure sensitive adhesive layer at least partially within said minor portion of each or said panels to adhere said sheet component to said panel; providing score lines about the periphery of said minor portion of each of said panels, said score lines being constructed and arranged to allow said sheet component, said pressure sensitive adhesive layer, the portion of said release coating layer in said minor portion of said panel, and said minor portion of said panel itself to be removed from the remainder of said panel as an integral laminate unit; and, removing said integral laminate unit from the remainder of each of said panels, each of said integral laminate units thereafter comprising said sheet component, said pressure sensitive adhesive attached thereto, and said release-coated minor portion of said panel adhered to and covering said pressure sensitive adhesive, said minor portion of said panel functioning as a releasable liner on said integral laminate unit, which releasable liner, when removed, exposes the pressure sensitive adhesive attached to the sheet component, facilitating subsequent adhesion of the sheet component to another object.

2. A method of manufacturing adhesive backed sheet components having release liners attached to and covering the adhesive backs thereof, according to claim 1, wherein each of the panels of said sheet substrate comprises an imprinted business form, wherein each of said sheet components includes an inner surface adhered to said pressure sensitive adhesive and an imprinted outer surface, and further including, prior to removing said integral laminate unit from said panel, the step of passing said panel through a printer and imprinting data on said form and on said outer surface of said sheet component.

3. An elongate, marginally punched, continuous sheet substrate, comprising a series of consecutive panels that are separable from one another along transverse score lines positioned therebetween, each of said panels including a laminated area thereon covering a minor portion of said panel, said laminated area including a layer of release coating material adhered to said minor portion of said panel, a layer of pressure sensitive adhesive material adhered to at least a portion of said layer of release coating material within said minor portion of said panel, and a sheet component positioned atop said pressure sensitive adhesive layer within said minor portion of said panel and held onto said panel by said pressure sensitive adhesive, each of said panels further including score lines positioned about the periphery of said minor portion of said panel, said score lines being constructed and arranged to allow said sheet component, said pressure sensitive adhesive layer, said release coating layer and said minor portion of said panel to be removed from the remainder of said panel as an integral laminate unit, said integral laminate unit comprising said sheet component, said pressure sensitive adhesive attached thereto, and said release-coated minor portion of said panel adhered to and covering said pressure sensitive adhesive, said minor portion of said panel functioning as a releasable liner on said integral laminate unit, which releasable liner, when removed, exposes the pressure sensitive adhesive attached to the sheet component, facilitating subsequent adhesion of the sheet component to another object.

4. An elongate, marginally punched, continuous, sheet substrate according to claim 3, wherein each of the panels of said sheet substrate comprises an imprinted business form, wherein each of said sheet components includes an inner surface adhered to said pressure sensitive adhesive and an imprinted outer surface, and wherein said sheet component is adhered to said sheet substrate with sufficient strength so that said substrate and said adhered components may be passed through a printing device without separation of said components from said substrate thereby to allow imprinting of predetermined data on each of said components and said substrate.

5. An elongate, marginally punched, continuous sheet substrate according to claim 3, wherein said sheet component comprises an end product selected from a group of end products including cards, tags, labels, coupons, envelopes, decals, stickers, name plates, badges, signs, shelf strips and shelf pointers.

6. An elongate, marginally punched, continuous sheet substrate according to claim 4, wherein said sheet component comprises an end product selected from the group of end products including cards, tags, labels, coupons, envelopes, decals, stickers, name plates, badges, signs, shelf strips and shelf pointers.

* * * * *